US007306420B2

(12) United States Patent
Roura Adell et al.

(10) Patent No.: US 7,306,420 B2
(45) Date of Patent: Dec. 11, 2007

(54) METHOD AND APPARATUS FOR EMPTYING BLOOD PLASMA CONTAINERS

(75) Inventors: Sergi Roura Adell, Barcelona (ES); Jose Ramon Sanchez Sabate, Barcelona (ES); Victor Grifols Lucas, Parets del Valles (ES)

(73) Assignee: Probitas Pharma S.A., Barcelona (ES)

( * ) Notice: Subject to any disclaimer, the term of this patent is extended or adjusted under 35 U.S.C. 154(b) by 448 days.

(21) Appl. No.: 10/389,383

(22) Filed: Mar. 14, 2003

(65) Prior Publication Data

US 2003/0185732 A1 Oct. 2, 2003

(30) Foreign Application Priority Data

Mar. 26, 2002 (ES) ..... 200200717

(51) Int. Cl.
*B65G 65/23* (2006.01)

(52) U.S. Cl. ..... 414/412

(58) Field of Classification Search ..... None
See application file for complete search history.

(56) References Cited

U.S. PATENT DOCUMENTS 3,420,392 A * 1/1969 Flint ..... 134/102.1
4,340,152 A * 7/1982 Ekholm, Jr. ..... 222/1
4,994,021 A * 2/1991 Smith et al. ..... 604/6.04
5,829,634 A * 11/1998 Gloger et al. ..... 222/1

* cited by examiner

*Primary Examiner*—Cecilia J. Tsang
*Assistant Examiner*—Christina M. Bradley
(74) *Attorney, Agent, or Firm*—Darby & Darby P.C.

(57) ABSTRACT

The method comprises a first stage of formation of a batch of a specific number of full containers to be emptied, which are then subjected to an operation of external washing by spraying with hot, de-ionized water and a subsequent rinsing operation, likewise by spraying with de-ionized water, passing then to a step of drying of the containers and afterwards to a step of cutting off one end of the containers, which then pass to a gripping step, in the same number of containers that were arranged in the batch at the start of the method, these being inverted to permit the fall and collection of the masses of plasma.

2 Claims, 3 Drawing Sheets

METHOD AND APPARATUS FOR EMPTYING BLOOD PLASMA CONTAINERS

The present invention is intended to disclose a method and its apparatus for emptying blood plasma containers, which is applicable to the handling of containers of plasma in pharmaceutical laboratories, contributing significant characteristics of novelty and of inventive activity to its operation.

As is known, the handling of human plasma in laboratories specializing in pharmaceutical products related to blood plasma is based on using bottles which contain the plasma collected from donors, and which arrive at the laboratory frozen in order to preserve them, and carrying out the operations necessary for the utilisation of the product for pharmaceutical applications.

At present, the handling of the containers is carried out by semi-manual methods, with which it is not possible to guarantee optimum utilisation of the plasma from each of the bottles. It constitutes an important problem, especially from the point of view of costs, since in view of the high price of human plasma, imperfect emptying of the bottles, wasting a certain percentage of the product, represents a significant cost factor. Moreover, the procedure of defrosting and emptying the plasma affects the yield of the proteins which will subsequently be obtained in the fractionating process.

The present invention is intended to disclose a method and apparatus for achieving the automatic emptying of the bottles of plasma with a high yield, permitting substantially complete emptying thereof, that is to say, full utilisation of their contents.

According to the present invention, the bottles are subjected to a continuous process, part of which is performed outside the partition dividing the clean or aseptic room, in which the emptying of the bottles takes place, from the adjacent room for loading same, passing to a step of washing by means of hot, de-ionised water, afterwards passing to a rinsing step, likewise with de-ionised water, sprayed by means of nozzles, the water being recovered in the washing tank, after which follows a stage of drying by spraying with clean air drawn from the same room via a high-pressure fan and spray nozzles, after which there is a gripping and cutting step in which the top of the bottle is removed automatically, being collected in a suitable hopper, and finally emptying takes place by gravity with the assistance of compressed air to facilitate the discharge and internal drying of the bottles.

In order to carry out the method, the present invention provides for the production of a single installation in the form of a tunnel with a conveyor belt which starts in the entry section outside the clean or aseptic enclosure in which is located the remainder of the apparatus, which has a first washing zone equipped with spray nozzles for spraying hot, de-ionised water recirculated from a suction tank by means of a pump, and with the aid of a heat exchanger, in order to reach the bottle washing temperature. After the washing section, the conveyor belt transports the bottles in batches of the same number as a unitary group to the rinsing zone in which there are nozzles for spraying de-ionised water, the installation then comprising a drying zone to which the bottles are transported by the same belt and in which clean air drawn from the room through the high-pressure fan is blown by means of suitable nozzles. The installation continues with a pressing device by means of a counter-mould form which grips the unitary group of bottles, for example three bottles, by means of compressed air, having individual blade devices, preferably actuated by pneumatic cylinder and piston assemblies, for transverse cutting of the top of the bottle, after which the same installation has fibreoptic sensors for detecting the presence of the bottles, the zone including a robot which has a special part for simultaneously picking up the bottles which make up the unitary group which was previously subjected to washing, rinsing and de-frosting, effecting the emptying of the bottles and their subsequent discharge to a hopper for collecting the empty bottles.

For the sake of greater understanding, some drawings showing a complete installation for the implementation of the present invention are appended by way of non-limiting explanatory example.

Figure 1:
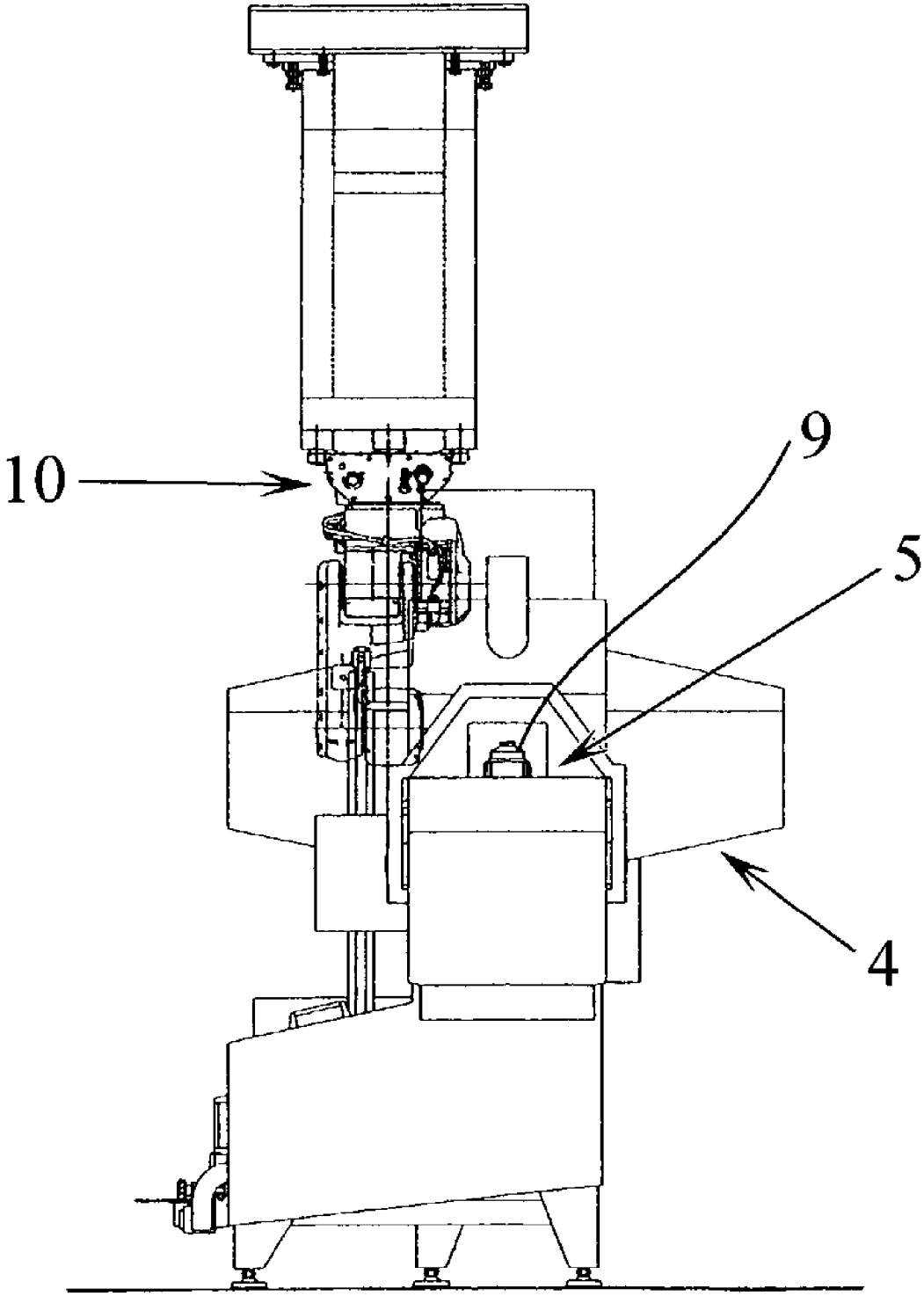
FIG. 1 is a view in front elevation of a complete machine for the implementation of the present invention.
Figure 2:
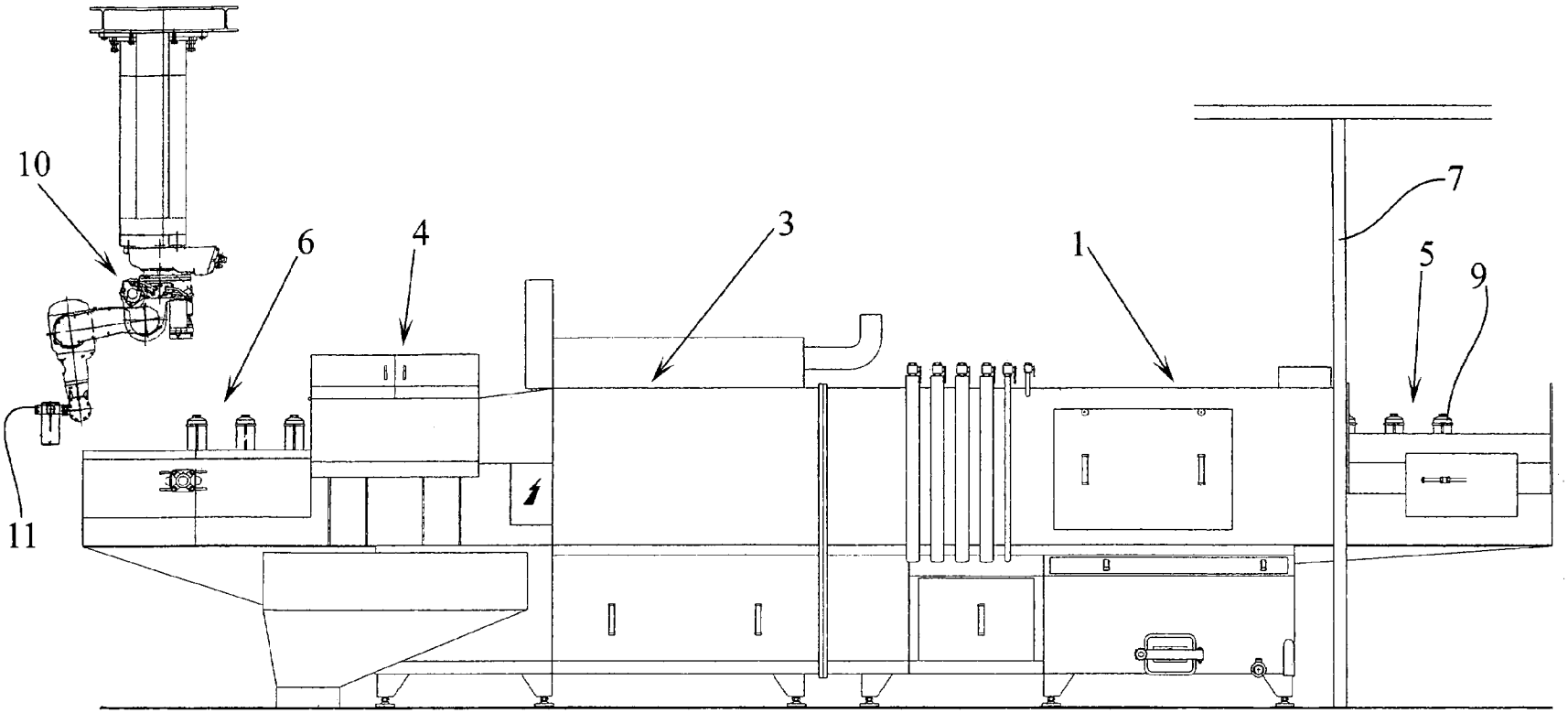
FIG. 2 shows a lateral view in elevation.

The machine is made up in the form of a single assembly consisting principally of a tunnel in which is arranged a bottle-washing section 1, which continues in a rinsing section 2, and a drying section 3, following which there is the cutting press 4 for the bottles. The machine has an entry zone 5 for the introduction of the bottles into the process and a discharge zone 6 in which the discharge of the partially defrosted plasma and the discharge of the bottles take place.

The entry section 5 is located outside the enclosure termed clean or aseptic, which is separated off by the partition shown diagrammatically by the number 7.

In the entry zone 5, a conveyor belt 8 receives the bottles 9 in the planned number, for example, in groups of three bottles, by manual placement, passing then to the bottle washing zone 1, in which the bottles are washed by means of de-ionised hot water which is recirculated from a tank from which it is drawn by means of a pump, these not having been shown. Heating may be carried out by means of any type of heat exchanger, for example a steam heat exchanger, until the desired specified temperature is reached.

Figure 3:
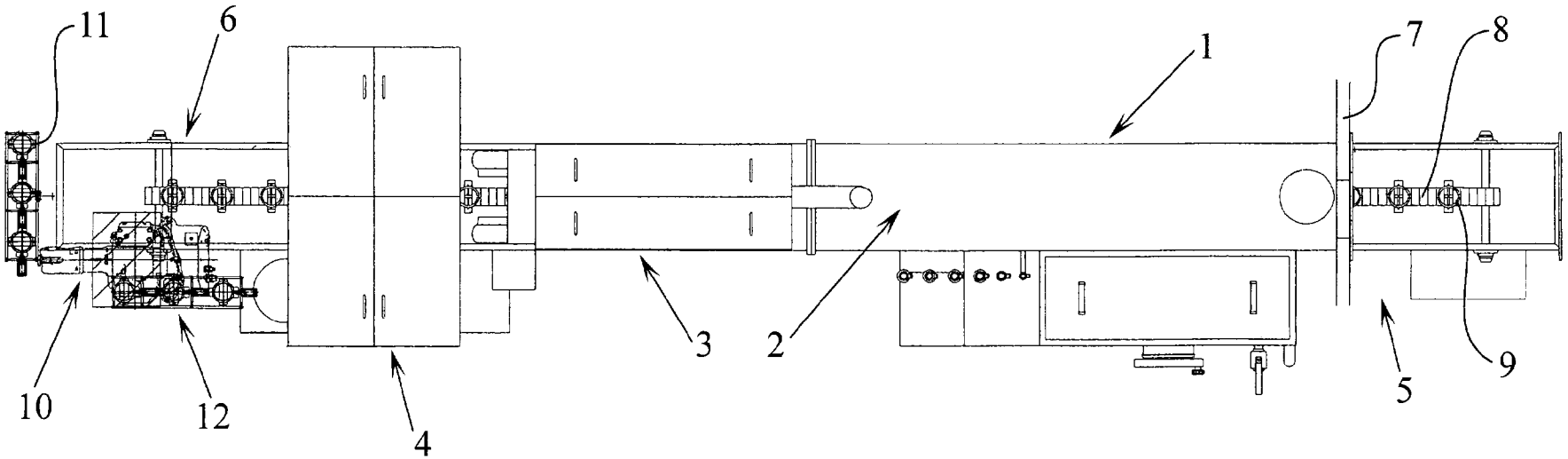
FIG. 3 shows a plan view of the same machine.

From the washing zone 1 the bottles pass, in unitary groups of the same number as put in place at the start, to the rinsing zone, in which they are subjected to the action of hot, de-ionised water in a similar manner to the washing water, by means of spray jets, the water being recovered in the washing tank and the surplus being eliminated by an overflow. Into the drying zone 3 is blown clean air, drawn from the same room through a high-pressure fan connected to nozzles, for example two nozzles, passing after drying to the cutting zone 4, in which the bottles are gripped and the transverse cutting of the rearward part is carried out by means of blades actuated by pneumatic cylinders or the like, the cut portions being collected in a hopper. The conveyor belt transports the cut units to the discharge zone, in which a robot 10 picks up the unitary group of bottles by means of a multiple gripping means 11 which moves them to the emptying point, indicated at the front of the machine in FIG. 3, subjecting the bottles to the action of gravity and completing the emptying and draining thereof by shaking and by the introduction of a spray gas, preferably filtered air. The bottles are then transported to the discharge zone 12, in which they are deposited in a collecting hopper.

As will be observed, the purpose of the machine of the present invention is that of handling the bottles of plasma until the masses of half-frozen plasma are emptied into a collecting hopper, from which it will pass to the melting zone, which does not form part of the machine.

One of the essential advantages derived from the present invention is that there is no human handling of the blood plasma, so that the risk of contamination conventionally involved in said handling is avoided.

The invention claimed is:

1. A method for emptying blood plasma containers comprising the steps of:

forming a batch of a specific number of containers holding blood plasma to be emptied;

subjecting the containers to an external washing operation by spraying with hot, recirculated de-ionised water;

subjecting the containers to a rinsing operation subsequent to the washing operation, by spraying with de-ionised water from a water source separate from the washing water;

drying the containers;

cutting off a top end of the containers;

gripping the same number of containers that were arranged in the batch at the start of the method and inverting the containers to permit the fall and collection of the masses of blood plasma; and removing the empty containers;

wherein the batch of containers is transferred as a unitary group through the process.

2. The method for emptying blood plasma containers according to claim 1, wherein the steps of washing, rinsing and drying of the containers, results in the partial defrosting of the blood plasma, permitting the fall, by gravity, of the blood plasma contained in each container.

* * * * *

UNITED STATES PATENT AND TRADEMARK OFFICE

CERTIFICATE OF CORRECTION

PATENT NO. : 7,306,420 B2
APPLICATION NO. : 10/389383
DATED : December 11, 2007
INVENTOR(S) : Sergi Roura Adell et al.

It is certified that error appears in the above-identified patent and that said Letters Patent is hereby corrected as shown below:

On the title page item (73), in the Assignee:

Delete "Probitas Pharma S.A., Barcelona (ES)" and insert --Grifols, S.A., Barcelona, (ES)--

Signed and Sealed this

Twenty-seventh Day of May, 2008

JON W. DUDAS
*Director of the United States Patent and Trademark Office*